US011272763B2

(12) United States Patent
Provencher

(10) Patent No.: US 11,272,763 B2
(45) Date of Patent: Mar. 15, 2022

(54) MAGNETIC CLASP SYSTEM

(71) Applicant: Samuel David Provencher, Waltham, MA (US)

(72) Inventor: Samuel David Provencher, Waltham, MA (US)

(73) Assignee: Boston Inventions, LLC, Waltham, MA (US)

( * ) Notice: Subject to any disclaimer, the term of this patent is extended or adjusted under 35 U.S.C. 154(b) by 0 days.

(21) Appl. No.: 16/874,183

(22) Filed: May 14, 2020

(65) Prior Publication Data

US 2020/0268112 A1 Aug. 27, 2020

Related U.S. Application Data

(63) Continuation-in-part of application No. 16/410,466, filed on May 13, 2019, now Pat. No. 10,881,171.

(60) Provisional application No. 62/669,997, filed on May 11, 2018.

(51) Int. Cl.
*A44B 11/25* (2006.01)
*A44B 11/04* (2006.01)

(52) U.S. Cl.
CPC ..... *A44B 11/2592* (2013.01); *A44B 11/04* (2013.01); *A44D 2203/00* (2013.01)

(58) Field of Classification Search
CPC ... A44B 11/2592; A44B 11/04; A44B 11/065; A44D 2203/00; Y10T 24/4086; Y10T 24/4093
See application file for complete search history.

(56) References Cited

U.S. PATENT DOCUMENTS

| | | | | |
|---|---|---|---|---|
| 793,751 | A * | 7/1905 | Sykes | F16G 11/04 403/211 |
| 3,148,427 | A * | 9/1964 | Hoffstrom | B65D 63/08 24/196 |
| 6,698,070 | B2 | 3/2004 | Chen | |
| 9,334,091 | B2 * | 5/2016 | Zantout | B65D 63/1072 |
| 9,682,806 | B2 * | 6/2017 | Zantout | B65D 63/10 |
| 9,907,367 | B2 | 3/2018 | Paik et al. | |
| 9,936,772 | B2 | 4/2018 | Paik | |
| 10,143,270 | B2 | 12/2018 | Fiedler et al. | |
| 10,617,179 | B2 | 4/2020 | Fiedler et al. | |
| 2017/0127764 | A1 | 5/2017 | Fiedler | |

* cited by examiner

*Primary Examiner* — Robert Sandy
(74) *Attorney, Agent, or Firm* — Travis Lee Johnson; Ascentage Patent Law

(57) ABSTRACT

A magnetic clasp system, having a clasping assembly, which includes a top portion, a bottom portion, and a pin defining a patch configured to receive a strap, and wherein the bottom portion includes a magnetically responsive material. The magnetic clasp system also including a mounting assembly, the mounting assembly including a magnetically responsive material configured to draw the clasping assembly and the mounting assembly together when within a magnetic field thereof.

21 Claims, 11 Drawing Sheets

MAGNETIC CLASP SYSTEM

PRIORITY

This application is a continuation-in-part of U.S. patent application Ser. No. 16/410,466, which was filed on May 13, 2019, and which claims priority to U.S. provisional application No. 62/669,997, which was filed on May 11, 2018, both of which are hereby incorporated by reference in its entirety.

COPYRIGHT STATEMENT

A portion of the disclosure of this patent application document contains material that is subject to copyright protection including the drawings. The copyright owner has no objection to the facsimile reproduction by anyone of the patent document or the patent disclosure as it appears in the Patent and Trademark Office file or records, but otherwise reserves all copyright rights whatsoever.

BACKGROUND OF THE INVENTION

1. Field of the Invention

The disclosure relates to an adjustable magnetic clasp system for combining two ends of a strap or belt.

2. Description of the Prior Art

Present systems for closing a strap often involve the use of buttons, hook and loop type fasteners, snaps, and other mechanical methods for fastening two independent components together. One of the objectives of the present invention is to provide designs that are elegant, reliable and user-friendly.

SUMMARY

It is desirable to have clasp mechanism that secures a strap and is easily adjustable.

As such, contemplated herein is a magnetic clasp system. The magnetic clasp system has a clasping assembly, a strap, and a mounting assembly. The clasping assembly has a top having a top exterior surface and a top interior surface, a base having a base exterior surface and a base interior surface, two sidewalls each having an exterior surface and an interior surface, a first end, a second end, and a pin located in the interior of the housing. The pin, the top interior surface, and the lower interior surface define a path therebetween configured to receive a strap, and the straps enters the housing at the first open end, loops around the top of the pin back towards the first open end, and the returning strap is pressed against the entering strap by the lower interior surface, and the base includes a magnetically responsive material. The mounting assembly has a magnetically responsive material configured to draw the clasping assembly and the mounting assembly together when within a magnetic field thereof.

Also contemplated herein is a method of adjustably affixing a strap. The method includes placing a clasping assembly on top of a mounting assembly having a magnetically responsive material. The clasping assembly has a top having a top exterior surface and a top interior surface, a base having a base exterior surface and a base interior surface, two sidewalls each having an exterior surface and an interior surface, a first end, a second end, and a pin located in the interior of the housing. An end of the strap is pushed into the first open end of the housing and out the second open end of the housing with the strap positioned above the pin. The strap is bent downwards causing a loop to form in the strap. The end of the strap is pushed into the second open end and out the first open end with the strap positioned below the pin. The end of the strap is pulled until the bend in the strap abuts the pin.

The method can further include a step of pushing on the end of the strap and a portion of the strap positioned above the end of the strap towards the first open end, such that the bent or loop portion of the strap is forced out of the second end. This forcing of the bent loop out of the second end causes a natural spring force to cause the loop to want to expand and thus pull more of the strap through the clasping assembly. A user can now pull on the loop to adjust the direction of the upper or lower portion of the strap for lengthening or shortening purposes and then pull again on the strap portions outside of the first open end to secure the loop into the clasping assembly and again abut around the pin. This then causes the spring force of the bend and the friction of the strap overlaid on itself to affix within the clasping assembly. This can be done while the clasping assembly maintains magnetic connection with the mounting assembly or alternatively while they are not magnetically connected, wherein they can then reconnect with the desired strap length affixed to the clasp assembly.

This method of adjusting the strap provides for infinite positions is advantageous over prior art mechanism such as those requiring holes or other attaching mechanisms which are prone to stretching or tearing, such as the holes on a belt for connecting to a belt buckle or fastener.

DETAILED DESCRIPTION

The present embodiments have been invented to provide an elegant clasp system that is reliable and user-friendly, while also being aesthetically desirable.

Figure 1:
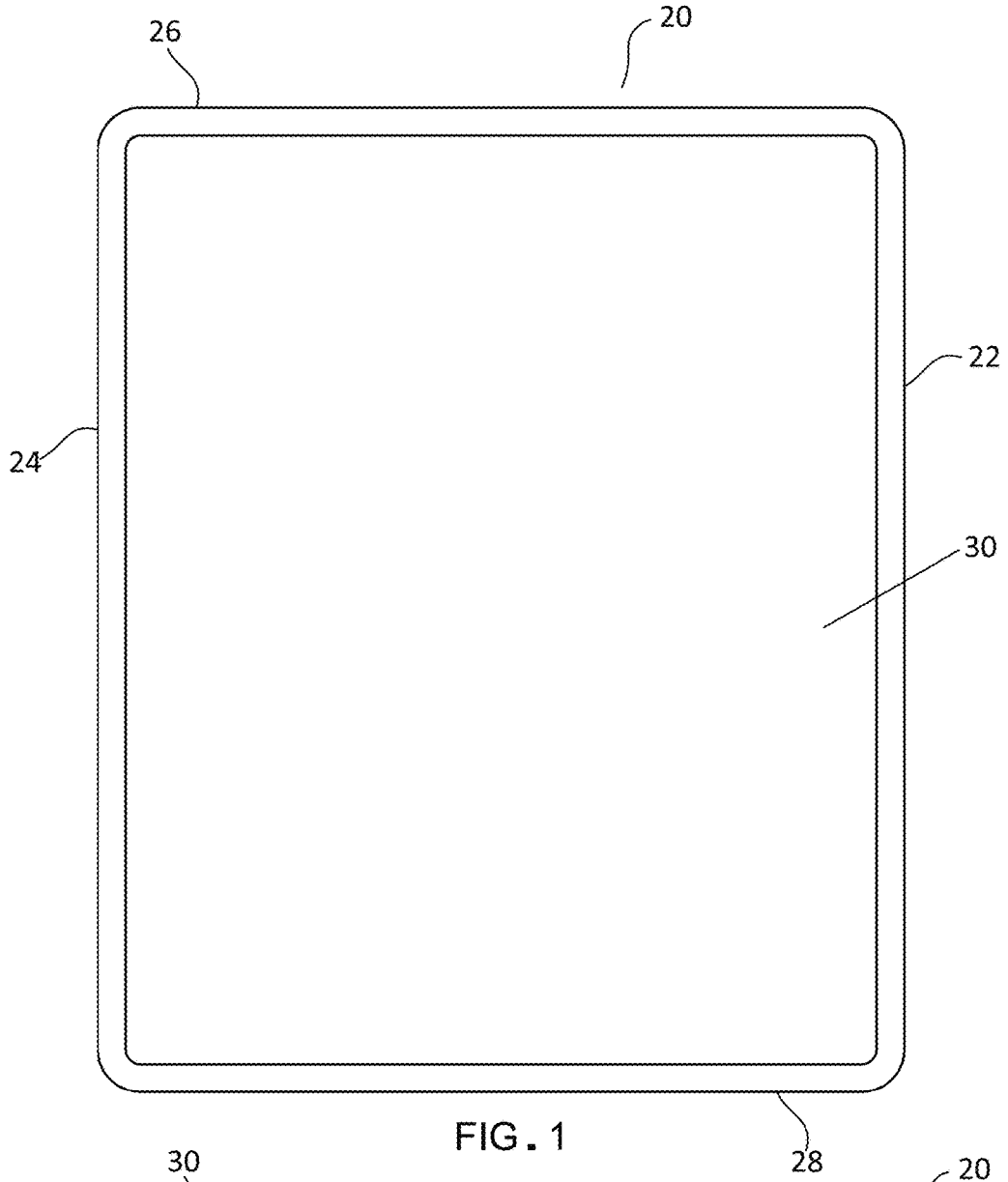
FIGS. 1-5 illustrate top, right, left, front and isometric views of clasp component for a magnetic clasp system in accordance with various aspects of the present invention.
Figure 2:
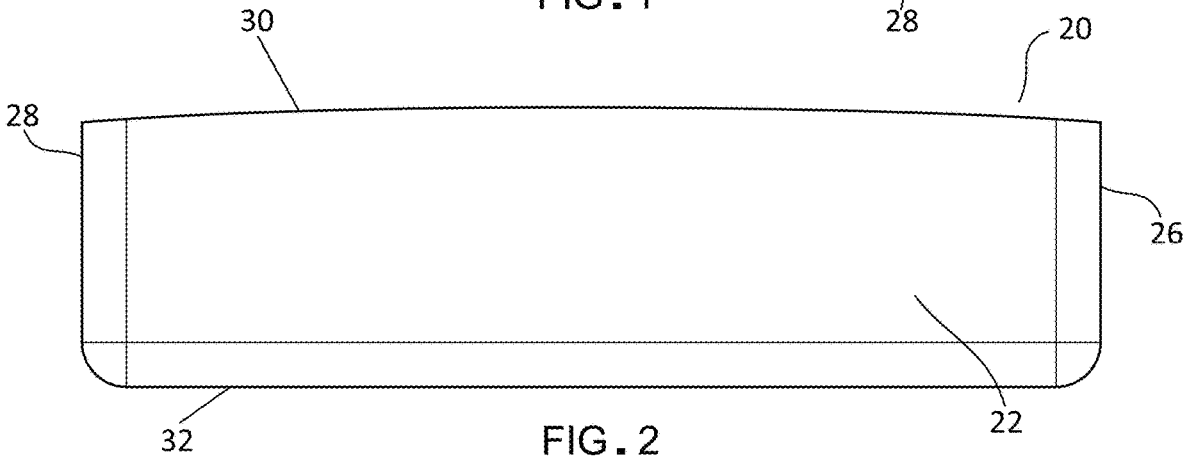
Figure 3:
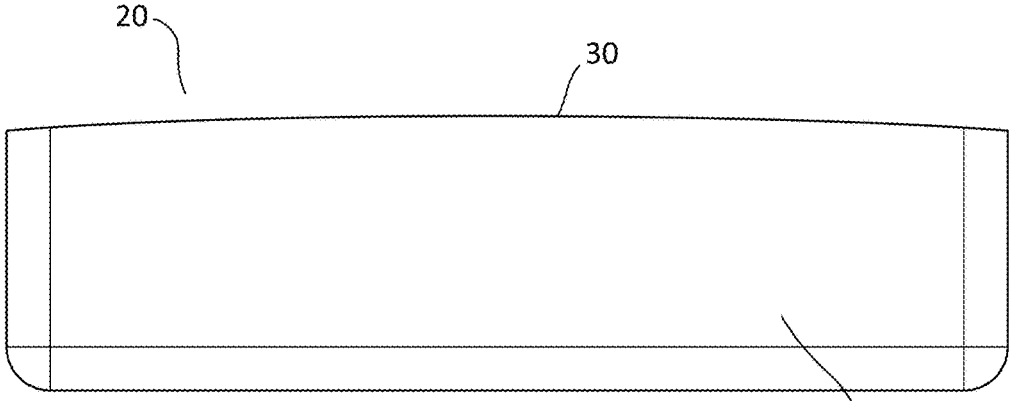
Figure 4:
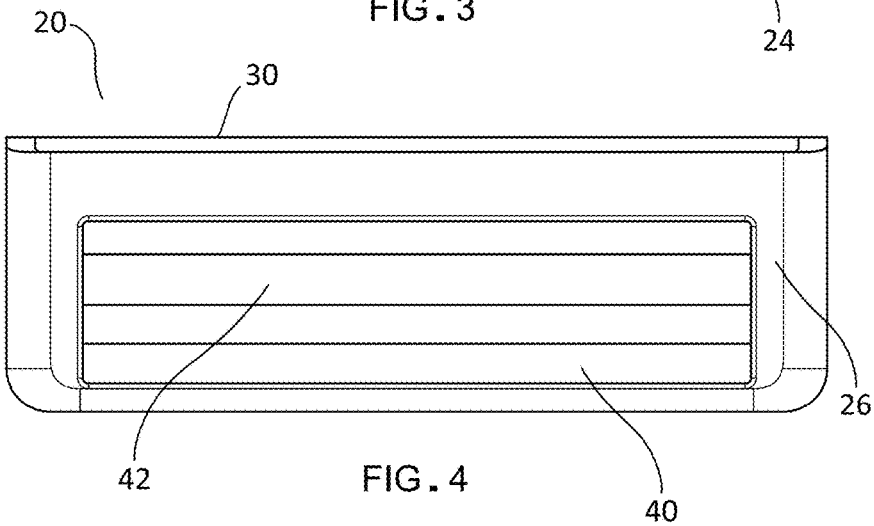
Figure 5:
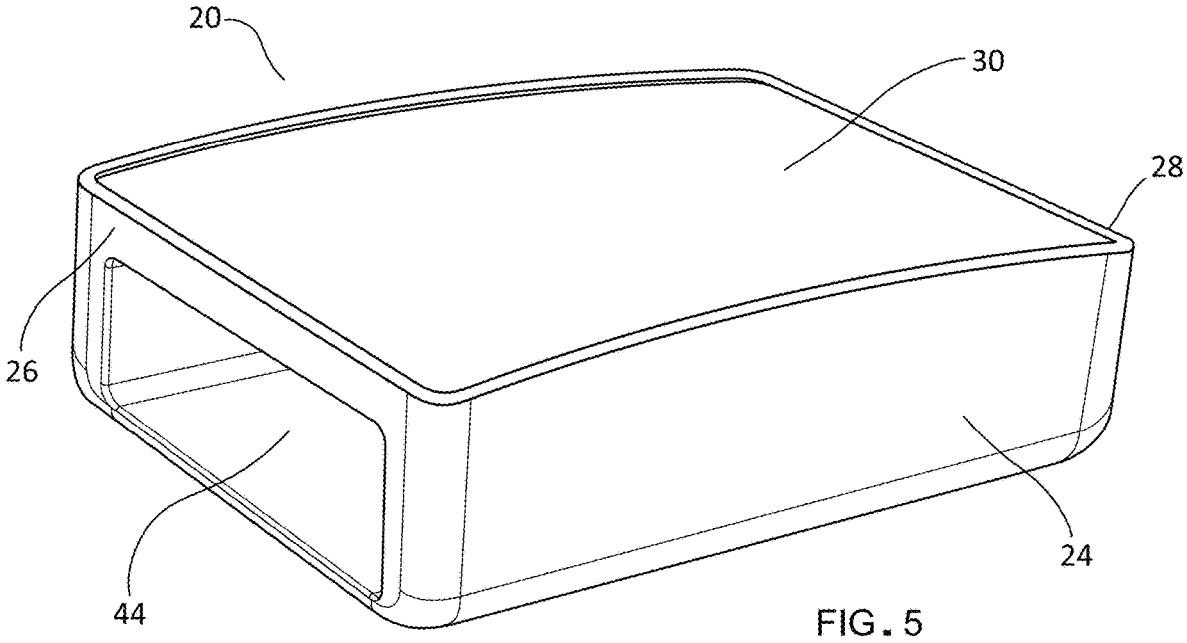

FIGS. 1-10 provided herein disclose one embodiment of a magnetic clasp system 10A. In particular, FIGS. 1-5 illustrate various views of the clasp assembly 20, having sidewalls 22 and 24, front surface 26, back surface 28, top surface 30, bottom portion 32 and channel 44. FIG. 1 illustrates a top view of the clasp assembly 20, while FIGS. 2-3 each show side views of clasp assembly 20. FIG. 4 illustrates a front view of clasp assembly 20, where pin 42 and deflection ridge 40 are disposed in the channel 44. The pin 42 is suspended between the sidewalls 22 and 24, while the deflection ridge 40 rises from the bottom portion 32 into the channel 44. FIG. 5 illustrates an isometric view of clasp assembly 20, showing channel 44, which extends from the front surface 26 through the back surface 28.

Figure 6:
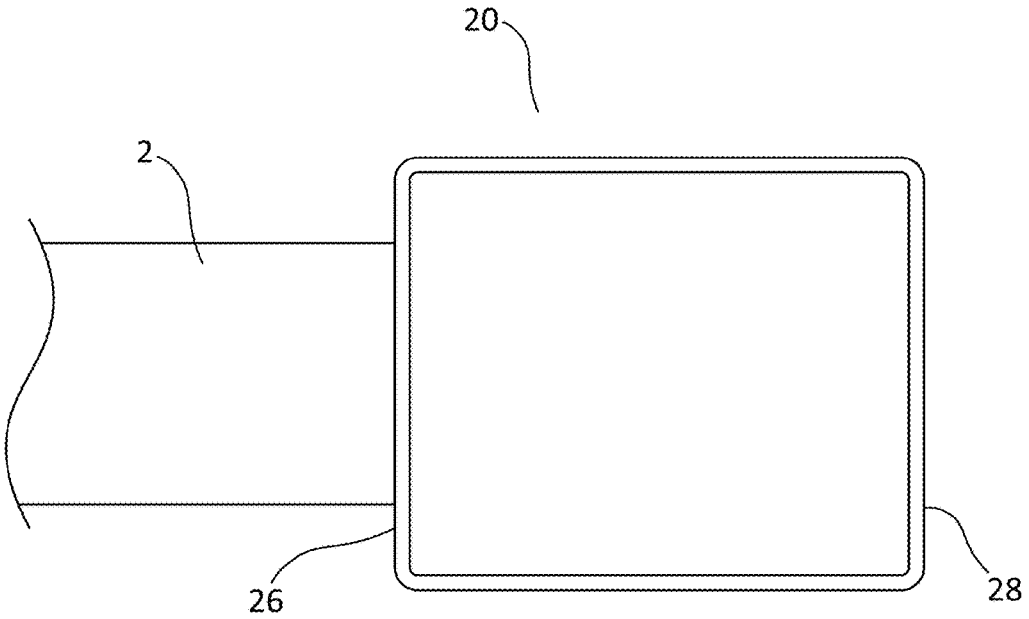
FIG. 6 illustrates a top of the clasp of FIGS. 1-5 including strap positioned therein.

FIG. 6 illustrates a strap 2 extending into the clasp assembly 20 through the front surface 26.

Figure 7:
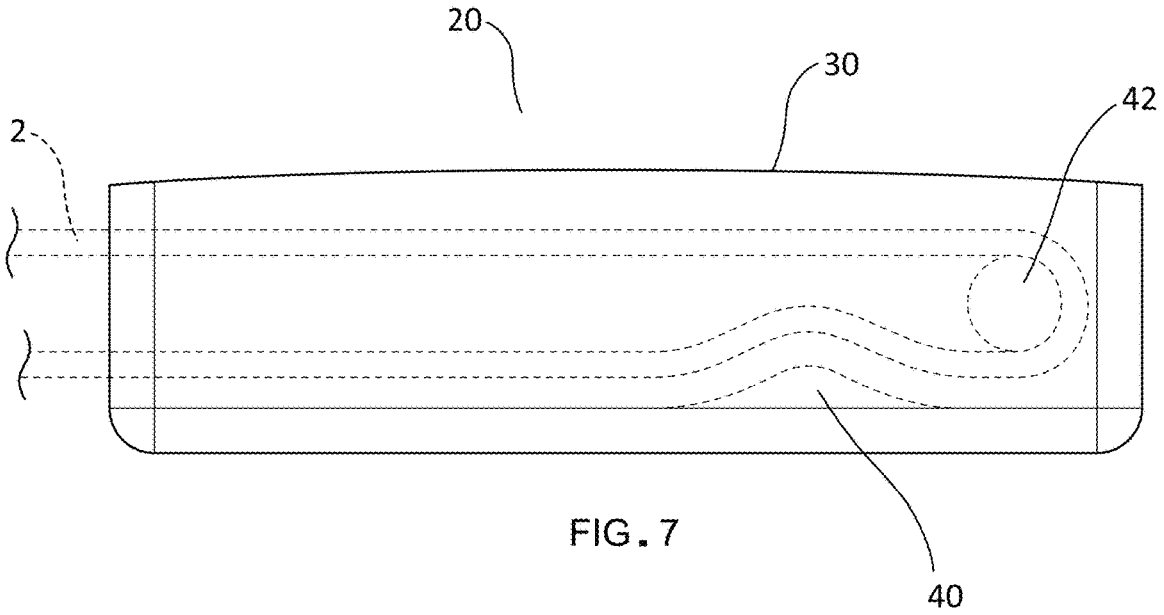
FIG. 7 illustrates a side view of the clasp showing a strap wrapping around an internal pin and over a deflection ridge therein.

FIG. 7 illustrates how the strap 2 is disposed within the channel 44 of clasp assembly 20 and in particular around pin 42 and over deflection ridge 40.

Figure 8:
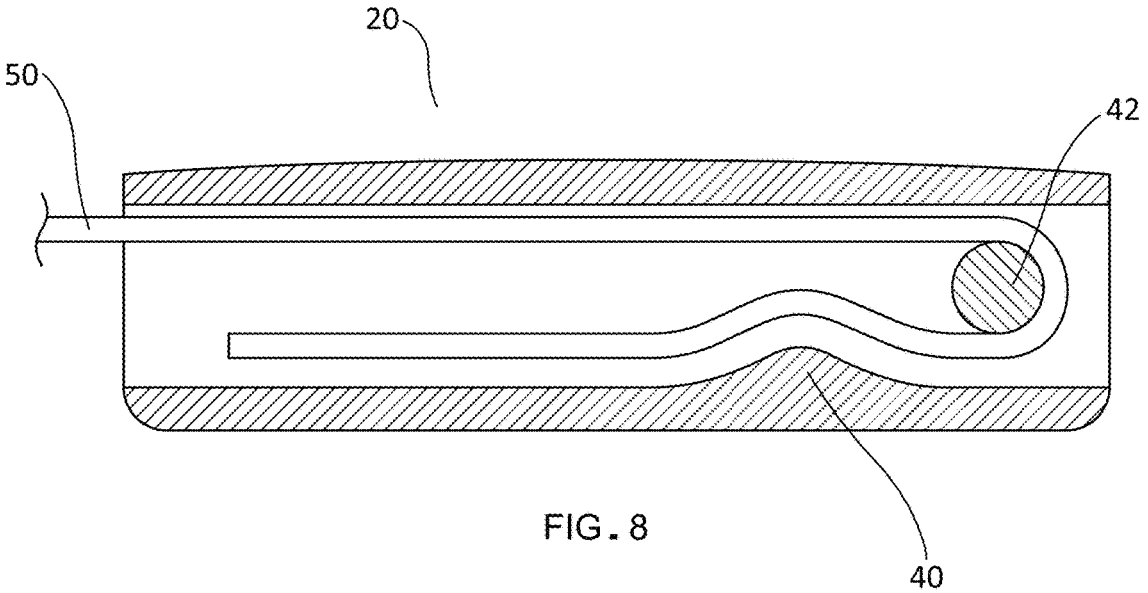
FIG. 8 is a cross-sectional view showing the path of the strap through the clasp and including the deflection ridge.

FIG. 8 is a cross-sectional of clasp assembly 20, again illustrating the tortuous path 50 that strap 2 extends into channel 44, around pin 42 and over deflection ridge 40. It should be noted that the placement of pin 42 and deflection ridge 40 are intentional within channel 44. In particular, the deflection ridge is placed on the bottom of clasp assembly 20 while the pin 42 is positioned close to the middle of the channel height. As strap 2 wraps around pin 42 and comes back across deflection ridge 40 the bending causes a bit of interference. Furthermore, where the bottom 32 is often placed against the item, person, appendage, about which the magnetic clasp system is placed allows for the portion of the strap above the pin, when placed in tension, to provide a force on a portion of the strap under the pin and resting on the deflection ridge.

One formulaic ratio that can help determine the distance from the outer circumference of the pin to the outer surface of the deflection ridge is $f(x)=0.95t$ where t is strap thickness. This function is largely impacted by the general thickness of the strap as it needs to pass under the pin and over ridge with a certain amount of compression. That compression can be ~5%, 7%, 8%, 10% and so forth. A secondary calculation of the height of the ridge is governed by the suppleness of the strap material along with the distance from the top of the ridge to the top surface of the strap channel, effectively allowing for the ridge to work alone in adding deflection and allowing both strap sections to pass through the channel. This could be done in conjunction with a compression factor that is spread across both strap sections passing over the ridge, which would be a modification of the earlier function with t=strap thickness, h=height of the strap channel and r=stiffness coefficient for the strap. The stiffness cofactor represents the pressure created by the rigidity of a strap that does not easily bend to follow the contour of the ridge. Similarly, in such a case the max height of the ridge would be $f(x)=h-(0.95t+0.95ts)$ Note that when threading the strap initially, the first section of the strap has the use of the entire space in the channel as the second section has yet to double back. In other words, the arrangement of the components of the clasp assembly are designed based on the thickness and suppleness of the strap to be used, which directly impact the height of the deflection ridge, size of the pin, and desired compression percentage.

This particular arrangement would not work as well, if the orientation were reversed. In fact, that is intentional to the design. As the clasp assembly 20 is formed of a magnetic material, when placed near the distal end of the strap 2 where an embedded magnet (or magnetic material) 6 is disposed therein, the bottom 30 of clasp assembly 20 is magnetically attached to the distal end over the embedded magnet 6. It should be understood that either clasp assembly 20 or magnet 6 could be formed of a magnet, magnetic material or portions thereof that are magnetic. Again, in this configuration when tension is placed on the strap, the arrangement of the strap through the clasp assembly prevents the strap from slipping while the magnetic force between clasp assembly 20 and magnet 6 keep the system together. Once the force is sufficient to overcome the magnetic force the clasp assembly 20 and magnet separate. When clasp assembly 20 is oriented with deflection ridge on top (upside down) the strap can be slid or adjusted through channel 44 easier as the orientation frees up the end of the strap for loosening. In other words, if the clasp assembly 20 were to be attached upside down to magnet 6, the forces on strap 2 within clasp assembly 20 would not be as prevalent and thus the system would not work as ideal. In fact, the strap may have force that loosens, which is less than the magnetic force keeping clasp assembly 20 and magnet 6 together, thus resulting in the strap 2 being freed from the channel 44 of clasp assembly 20.

Figure 9:
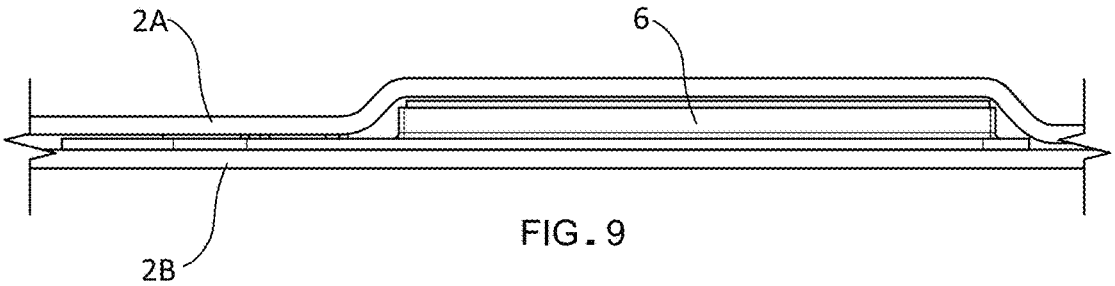
FIG. 9 is a cross-sectional view of an opposite end of the strap, which includes an embedded magnetic material therein.

FIG. 9 illustrates a cross sectional view of the embedded magnet 6 on the distal end of strap 2 as discussed above. The top portion 2A works with the bottom portion 2B of strap 2 to embed magnet 6 therein. As shown, the two portions can be sewn together, but other adhering or fix techniques can also be used. It should be noted, that magnet doesn't necessarily need to be fully embedded, but that a portion, such as the top surface could be exposed.

Figure 10:
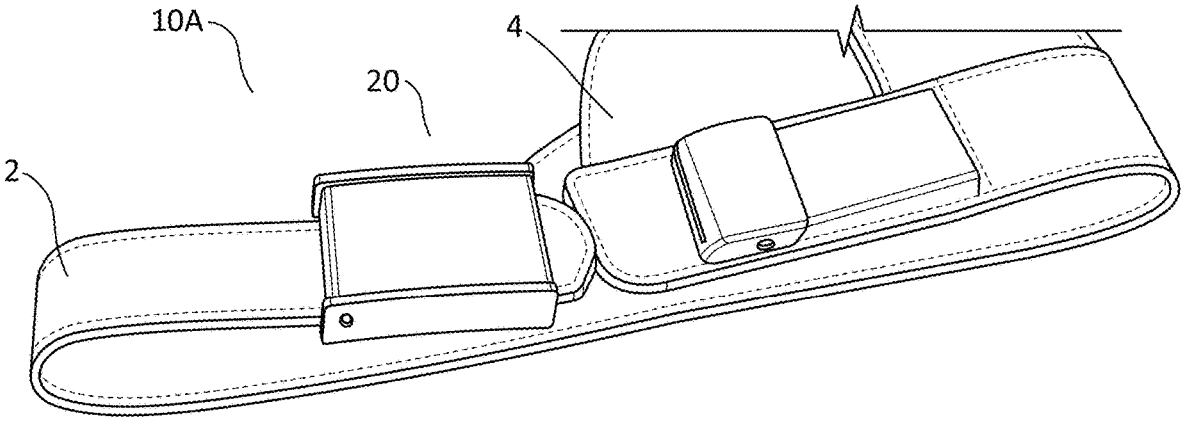
FIG. 10 illustrates a magnetic clasp system.

FIG. 10 illustrates the magnetic clasp system 10A in conjunction with a glove (that is only partially shown) where the magnetic clasp system 10A could be used with. This system could be used with belts, backpacks, gloves, purses, and incorporated into many other systems. It should be noted that the strap 2 does not necessarily need to form a complete loop as might be the case if the system were integrated with a bag or purse, which one of ordinary skill in the art would appreciate, but is commensurate with the scope of this application. In an application where adjustment to the length of the strap was not needed, the strap could be pre-measured cut and affixed back on to itself, via stitch, glue or some other increased compression.

The proceeding features and technical aspects have thus been described, but which also assist with the aesthetics, elegance and even ergonomics of the system. It should be noted that the top surface 30 has a curve to it, which is both pleasing to the eye and indicative of orientation, while the bottom surface 32 is flat and ideal for magnetically adhering. The sides, front and back surfaces have rounded corners and edges. The clasp assembly 20 is formed of a unitary design, which allows for ease with inserting a strap therein. There are no moving parts on this particular embodiment; however, that is not to say that pin 42 disposed in the channel could be affixed in either a fixed or rotating manner. The curve of deflection ridge 40 can be altered in multiple ways including have a more rounded top to a pointier ridge. The angle of the rise and fall of the ridge can also be modified.

In another embodiment, a paddle is provided in the interior of the clasp assembly that is hinged on the pin. When the strap is threaded in the clasp assembly 20, the paddle rests on the bottom of the channel, creating a ramp that guides the strap over the top of the pin. When the strap is pushed back into the interior of the clasp assembly 20, the strap pushes the paddle upwards and the paddle sits between the two strap sections.

The strap or belt can be formed of multiple types of materials including leather, cloth, fabric, or other compressible material. A non-compressible strap can be used so long as the strap is very rigid and resistant to bending. Also, it is possible to use a metal link strap as the strap, once a the strap loops around is directed in the opposite direction, the strap will not slip on the pin 42.

A second embodiment of a magnetic clasp system 10B is illustrated in FIGS. 11-15. In this embodiment the magnetic clasp system 10B has a pull through tortuous path for the strap 2, as opposed to a path that wraps around a pin like in the embodiment above.

Once again, the magnetic clasp system 10B will be discussed herein primarily in the context of use with respect to glove closures but can be similarly applied to any number of clasping systems with regard to other strap systems such as; belts, bag closures, linear ropes, box closures, tarp connections, or virtually any other scenario in which an adjustable closure or affixation point is desired. It will be appreciated that when referring to a strap, that any similar tensile structures are contemplated within the use of such a term. It will be understood to those having skill in the art, and having possession of this disclosure, that the magnetic clasp system 10A and 10B are of particular advantage in situations requiring clasping utilizing only a single hand.

In particular the magnetic strap system 10B can include a clasping assembly 100 which can be provided at an infinitely adjustable location along the strap 2, a mounting assembly 200, which is provided at a fixed point along an opposing end of the strap, or at another connection point, such as along the side of a truck, opposing side of a bag, etc. and a stop assembly 300.

Figure 11:
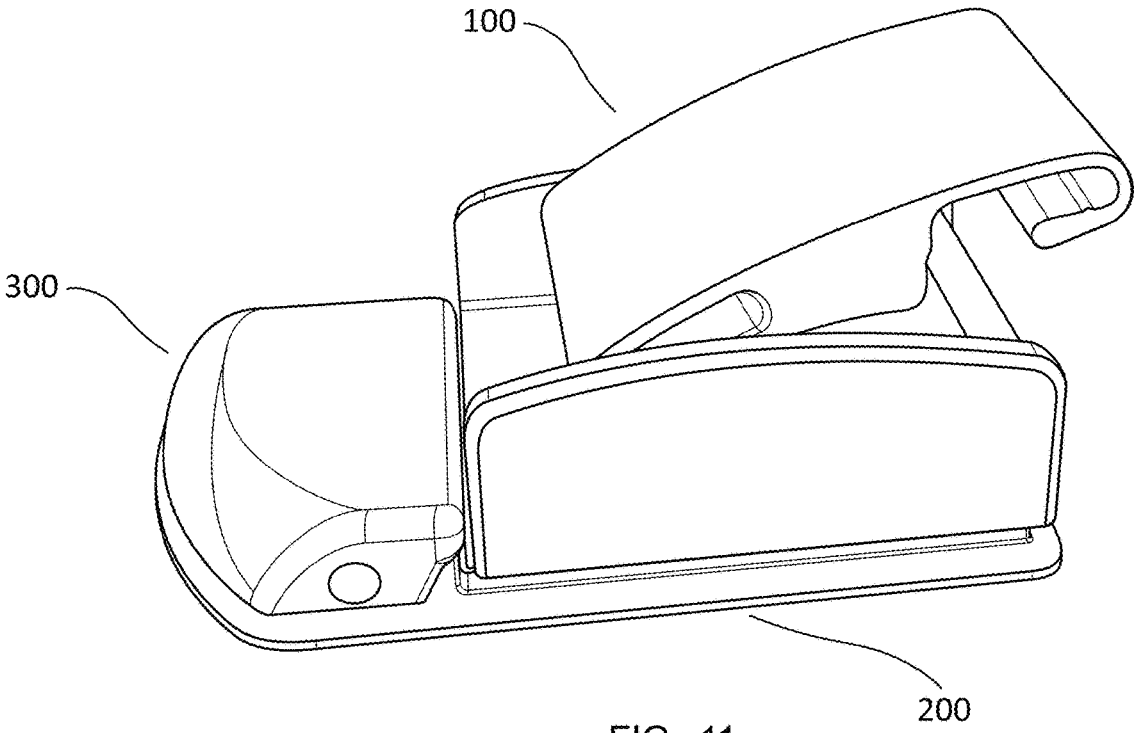
FIG. 11 is an alternative clasp embodiment and stopping mechanism.

FIG. 11 illustrates a perspective view of a magnetic clasp system 10B in accordance with various aspects of the present invention sans strap 2. In particular, it illustrates the clasp assembly 100, mounting assembly 200 and stop assembly 300.

Figure 12:
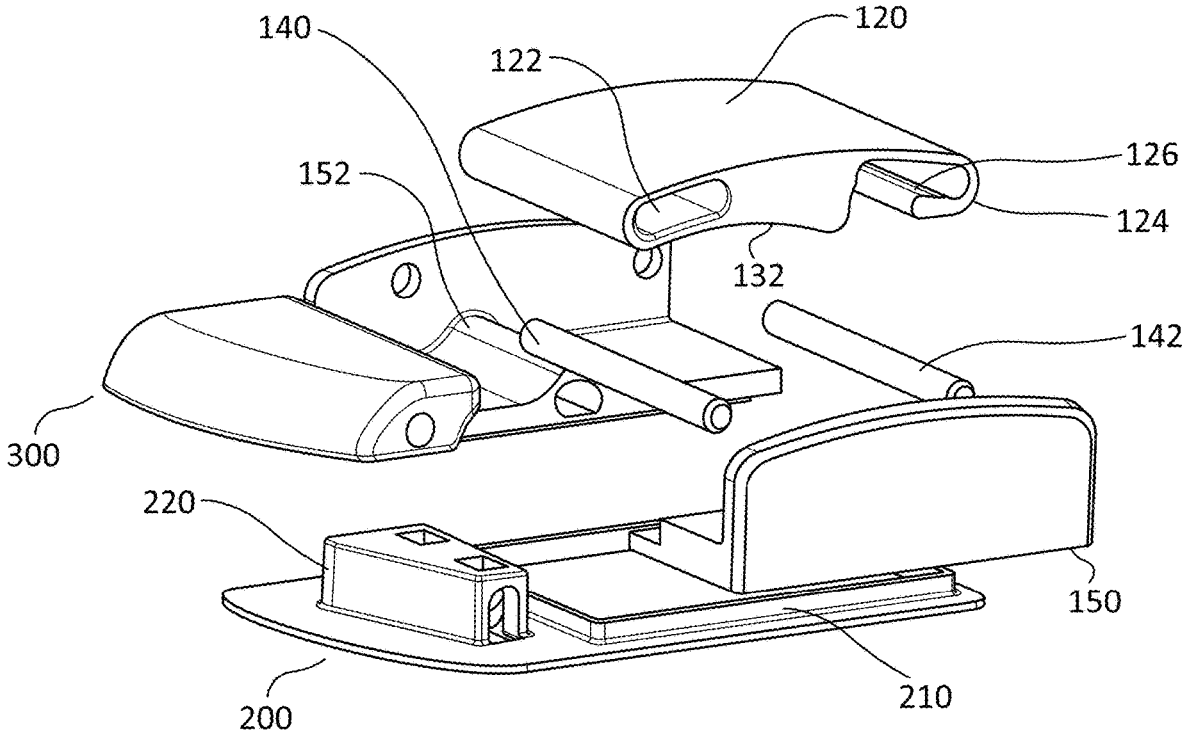
FIG. 12 is an exploded view of the alternative clasp embodiment and stopping mechanism of FIG. 11.

FIG. 12 illustrates an exploded view of the various components of FIG. 11. In particular, components associated with the clasp assembly include a hinged compression clasp 120, having a channel or slot 122, hook portion 124, optional hook protrusion 126, upper deflection ridge 128, recess portion 130, alignment blades 132, hinge pin 140, locking pin 142, base 150 that can be formed of two components for assembly or be unitary, having a bottom portion from which a base deflection ridge 152 is formed, and opposing sidewalls about which hinge pin 140 and locking pin 142 can be disposed between.

The slot or channel 122 of the hinge compression clasp 120 can be disposed about the hinge pin 140, so as to allow lateral motion as well as rotation about the hinge pin. The slot 122 is elongated and rounded to conform with the hinge pin 140. The hook portion 124 and optional hook protrusion 126 work to connect and snap into place about the locking pin 142.

The alignment blade(s) 132 can be provided about an edge portion of the recess 130. These alignment blades 132 can fit within the inner sidewalls of base 150 so as to ensure smooth operation of the hinge compression clasp 120. In some embodiments the alignment blades can extend further into the base and be received in a slot or recess, not shown, about the sidewalls of the base deflection ridge 152 so as to ensure proper alignment and smooth travel while translating. These alignment blades can be provided as a magnetic material or a magnetically responsive material so as to aide in the locking or retention force of the hinged compression clasp 120 within the base 150.

Also shown in FIG. 12 is the mounting assembly 200, which includes a recess 210 for mounting a magnet 6 or magnetic material therein. It also includes a mounting block 220, where the stop assembly can be mounted thereto.

Figure 13:
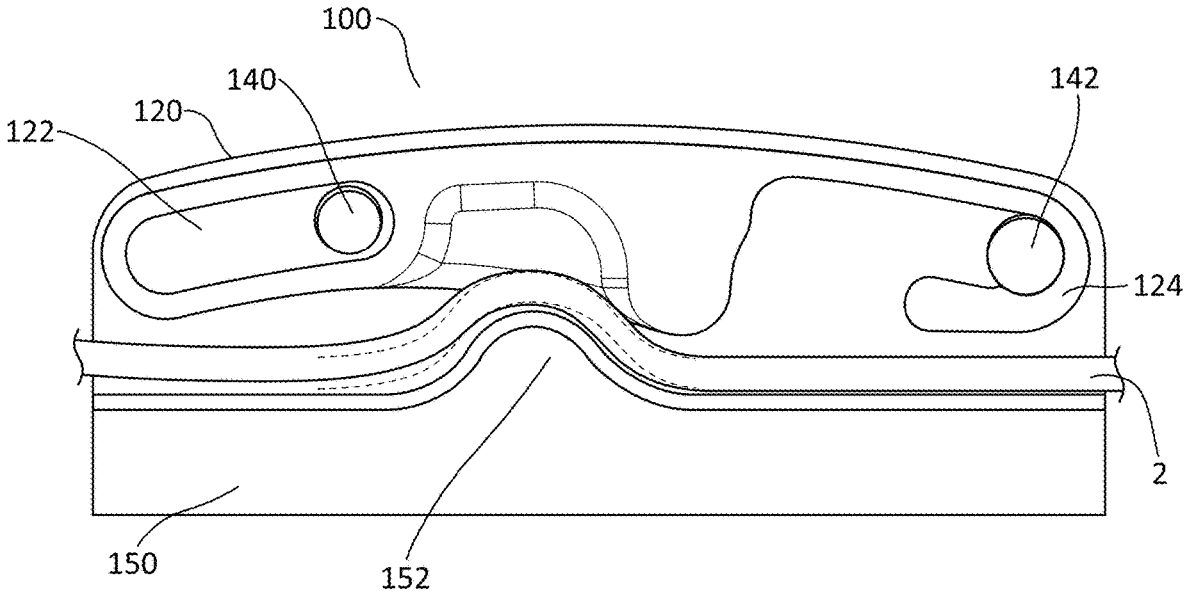
FIG. 13 is the cross-sectional front view of the alternative clasp embodiment of FIG. 11.

FIG. 13 illustrates a cross-sectional view of the clasp assembly 100 and the positioning of a strap 2 therein. In particular, the position of the hinge compression clasp 120 is shown in a closed configuration, as opposed to that shown in FIGS. 11-12. While in the closed configuration, the upper deflection ridge 128 is offset from that of the base deflection ridge 152, which form a tortuous path for the strap 2 to extend through. This closed state also places a compressive force onto the strap 2 such that lateral movement of the strap is deterred. This compressive force can cause some deformation of the strap 2, which helps provide the interference needed to prevent lateral movement in the closed state. A user can press upon the end of the hinge compression clasp 120 closest to the slot 122, which can slide laterally slide the hinge compression clasp 120 with respect to locking pin 142 and once free of the hook portion 124, the hook portion end of the hinge compression clasp pops open and rotates upwards and away from the strap 2. This open and closing operation can be done with one hand and can be done while the clasp assembly 100 is magnetically adhered to the mounting assembly 200 and abutted against the stop assembly 300.

Figure 14:
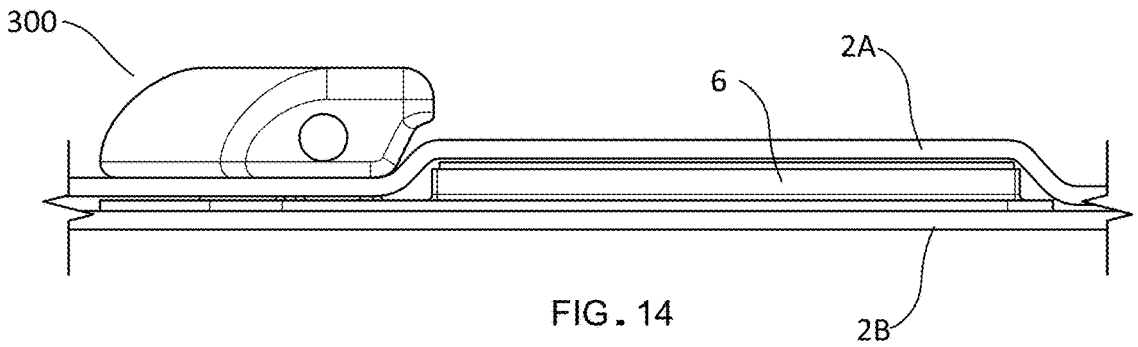
FIG. 14 is the one end of strap of the alternative embodiment having a magnetic material embedded therein with an adjacent stopping mechanism.

FIG. 14 illustrates a cross-sectional view of the magnet 6 disposed within the recess 210 of the mounting assembly 200 and embedded between the top and bottom portion 2A-B of strap 2. Similar to the first embodiment, the strap 2 can be sewn about or over the mounting assembly 200. It should be noted that the mounting block 200 can extend through an aperture or opening within the strap about which the stop assembly 300 can be disposed or mounted.

Stop assembly 300 can have a cantilevered portion 310 that extends towards and in some versions slightly over the magnet 6. The clasp assembly can be formed of a magnetic material, which allows for a magnetic adherence to the mounting assembly and prevent a certain amount of translational force, as well assist with alignment of the clasp assembly. The stop assembly 300 can deter additional translational motion in one direction, as tensional forces applied to the strap 2, which transfer through to the clasp assembly 100 may overcome the magnetic attraction or adherence between the clasp assembly 100 and the mounting assembly 200. In such circumstances the cantilevered protrusion can abut against a portion of the base 150 and provide for a mechanical or physical stop or impediment. In other words, the stop assembly 300 prevents sliding along one direction.

Figure 15:
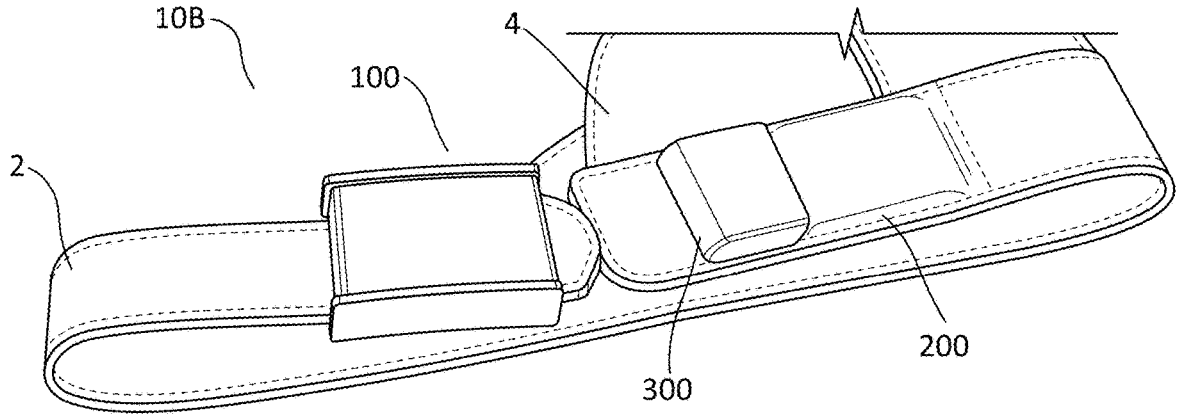
FIG. 15 is an alternative clasp embodiment.
Figure 16:
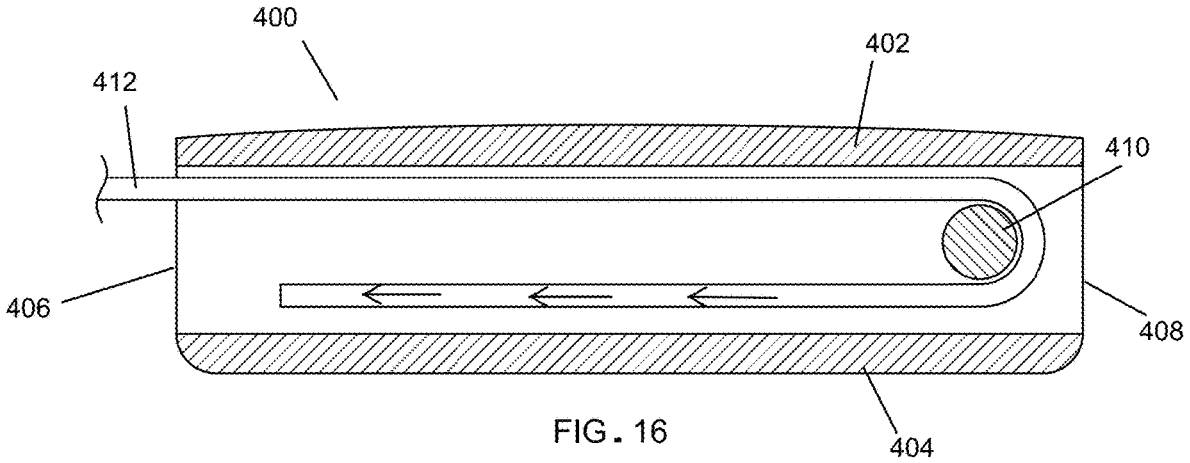
FIGS. 16-19 are cross-sectional views showing the path of the strap through the clasp.

FIG. 15 illustrates the magnetic clasp system 10B as incorporated with a glove 4.

It should be understood that the slot 122 and recess 130 should be provided with a sufficient lateral width so as to allow for proper translation of the hinged compression clasp 120 such that the hook portion 124 can engage around the locking pin 142 and interferingly engage therewith and be properly released when desired for readjustment along the strap.

In some embodiments the stop can be provided as replaceable and have various desirable cosmetic shapes. In some aspects of the present invention, a retention pin (not labeled) can be removable so as to allow for replacement of the stop assembly 300 with varying sizes, shapes, colors, materials, etc.

In some embodiments the mounting assembly 200 can be retained within the strap layers using an adhesive, or can merely be sandwiched, and rely on an interference fit when the edges of the strap are glued or sewn together.

Figure 17:
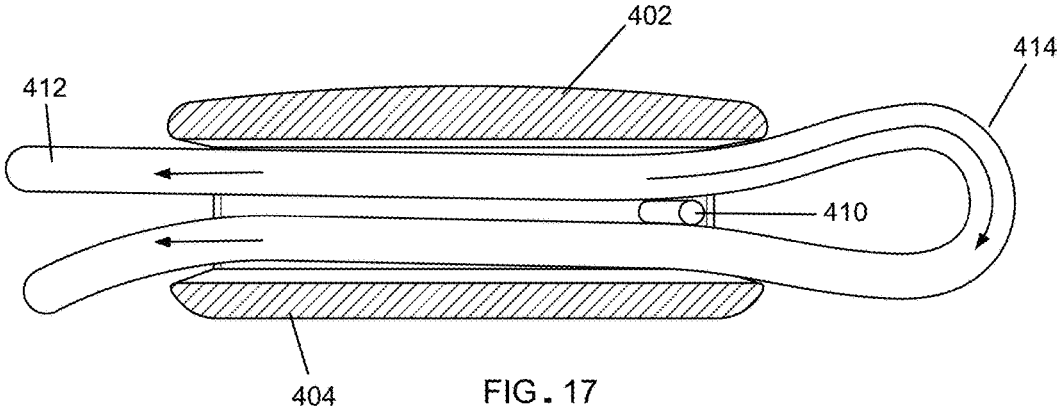
Figure 18:
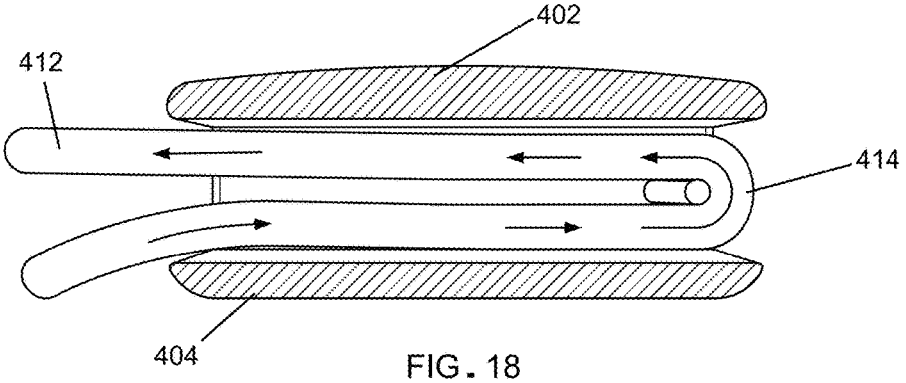

FIGS. 16-20 illustrate an alternative embodiment of a clasp assembly 400. The clasp assembly has a top portion 402, a bottom portion 404, a first open end 406, a second open end 408, and a pin 410 located in an interior of the clasp assembly. The pin 410 is located approximately equidistant from the top portion 402 and the bottom portion 404 and closer to the second open end 408 than the first open end 406. A strap 412 is fed into the interior of the clasp at the first open end 406, over the pin 410 and out the second open end 408. The strap 412 is then bent into a curve and fed back into the second open end 408, under the pin 410, and out the first open end 406 (FIG. 17). When the strap 412 is being pushed under the pin 410, the bend naturally balloons outside of the clasp 400. The strap 412 comprises a material that has some rigidity so that when the strap is bent the resistance to the bending functions as a spring. This occurs when bending the strap has a radius of curvature that is larger than a radius of the pin 410. When the user pulls on a portion the strap 412 where the strap enters the first open end and pulls on a portion of the strap 412 where the strap exits the first open end 406, the bend 414 is compressed and pulled tight against the pin 410 (as shown in FIG. 17). Compressing the strap 412 against the pin causes a large frictional force and degree of compression as the strap 412 is forced to accommodate the pin 410. The friction and compression prevent the strap from moving when the strap is pulled. If the user desires to more securely fix the strap in the clasp 400, the user pushes the end of the strap 412 back into the clasp 400 at the first opening 406 between the two portions of the strap. This cause greater compression on the strap in the interior of the clasp 400 creating an even tighter hold.

The inner height of the clasp 400 is selected so that once the strap 412 is fully engaged with the pin 410 there is a high degree of friction between the two sections of strap that contact each other. The compression and friction prevent the strap 412 from moving further when both the top portion of the loop and the bottom portion of the loop are pulled. The inner height can be selected to be higher if a thicker strap is used or lower if a thinner strap is used. The inner height will typically be between 3-15 mm.

Figure 19:
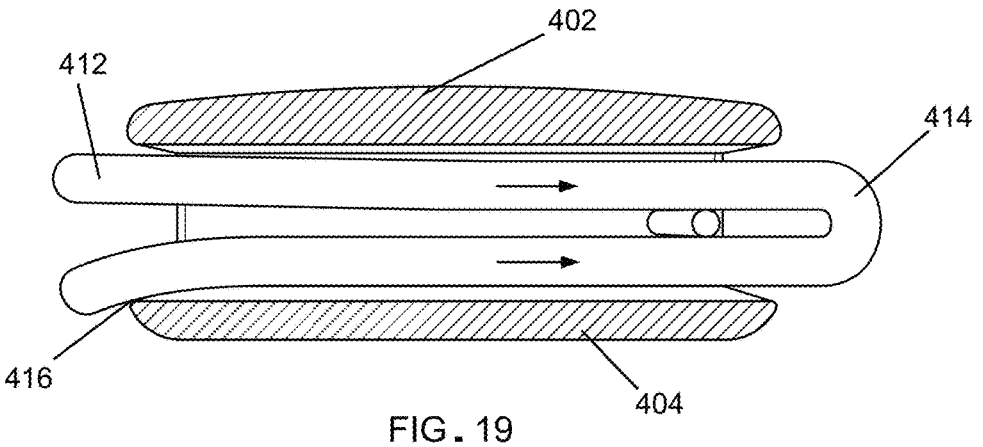

When the user desires to remove the clasp or loosen the clasp, the user simply pushes both portions of the strap 412 into the clasp 400 (see FIG. 19). This effectively disables the friction and the spring compression around the pin 410 allowing the strap 412 to be easily removed or adjusted. When the clasp 400 is worn on a wrist 500 (see FIG. 20), there is a downward force on the upper portion of the strap 412. This downward force creates a strap/pin lever that creates a downward binding of the bottom section of the strap as the bottom section of the strap exits the channel and makes an immediate downward turn at the end of the lower portion 416. The greater pulling force applied the more the strap is bound to clasp.

When engaged (and under tension) the downward pressure creates lateral friction of the two strap sections as they try to move in opposite directions. This causes binding interference that resists movement, as opposed to the action of pushing both straps together to disengage the clasp; this moves both straps together in the same direction, moving the compression loop away from the pin as it exits the clasp and is free to expand.

A second end of the strap 412 has a magnet 502 that exerts a magnetic force on the bottom portion 404 of clasp 400. The magnetic force pulls the clasp 400 down causing the strap between the magnet and the clasp to slightly compress and resist movement of the clasp. If the force on the clasp or strap becomes greater than friction between the clasp and the strap, the magnet (or clasp) will slide latterly, auto-adjusting and relieving pressure on the wrist 500. This allows for the clasp mechanism 400 to move and adjust while remaining fully functional.

One advantage of the present embodiment is that the clasp 400 and the strap channel mechanism is not a hard lock system and will eventually slip laterally if movement is warranted; to this end, the clasp auto-adjustment system allows proactive movement, preventing strap tension around the wrist from getting too high. Such tight constriction of the wrist is considered a health issue and is prevented by design. This advantage will be described below.

Figure 20:
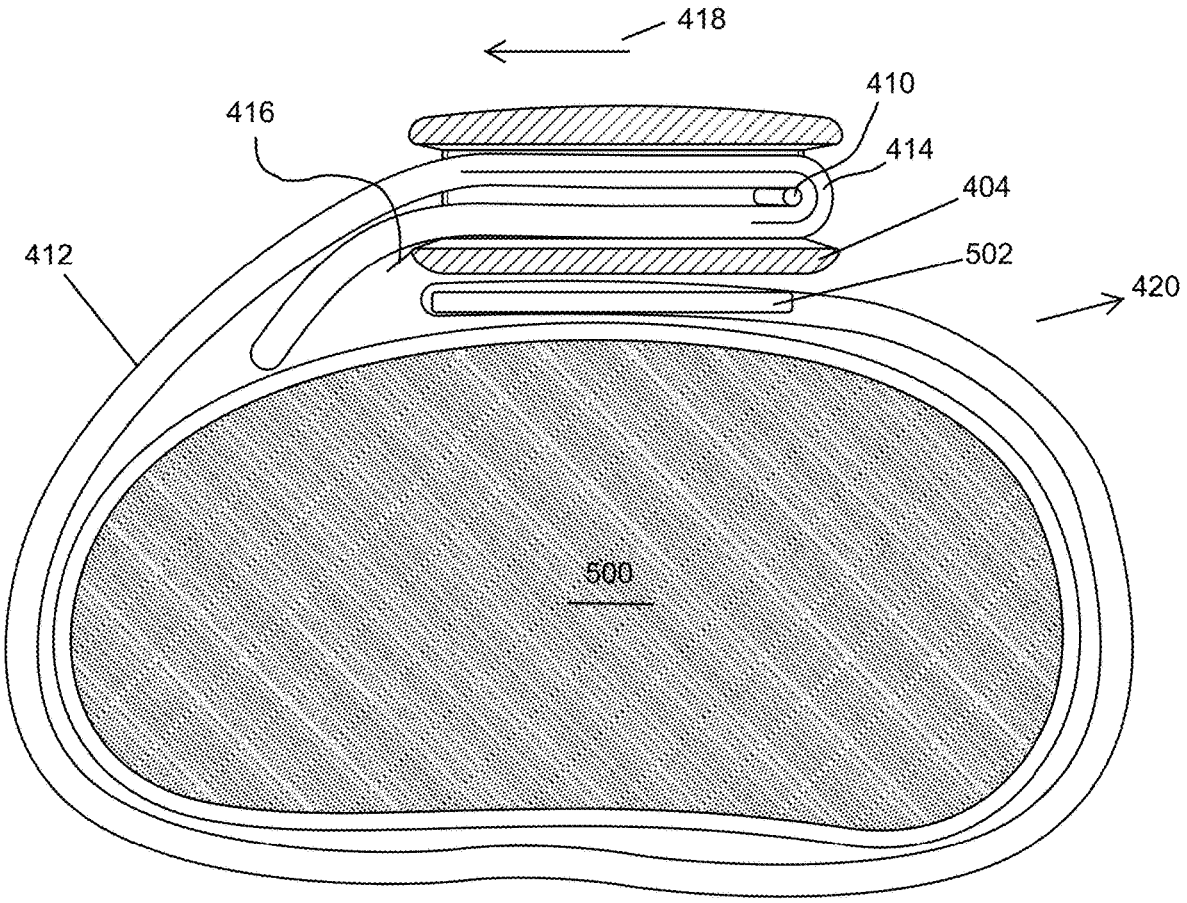
FIG. 20 is cross-sectional view of a magnetic clasp system worn around a person's wrist.

As shown in FIG. 20, the bottom portion 404 is magnetically coupled to the magnetic device 502. This magnetic coupling has the tendency to keep the lower portion 404 in place until a force that is greater than magnetic force causes the bottom portion 402 to move away from the magnetic device 502. The magnetic field exerts a vertical force on the lower portion which pulls (and holds) the clasp to the magnetic device 501. The magnetic field in combination with friction exerts a lateral force that keeps the clasp from sliding along the strap at the magnetic device 502. Lateral movement is movement in direction 418 or 420. When a force is exerted on the strap 412 in the direction 418, the loop 414 pulls against the pin 410. The loop pulling on the pin 410 eventually results in a lateral force that is greater than the magnetic lateral force and causes the pin (and thus the entire clasp) to slide in the direction 418 of the force. The clasp moves until the force exerted on the pin 410 is no longer greater than the magnetic force. The movement of the clasp causes the band to loosen around the wrist 500 preventing the band from becoming too tight and restricting blood flow within the wrist.

While it is important that pin 414 have a small diameter in order to create a very tight loop (as described above), the pin must be strong enough so that pin can withstand a pulling force that is greater than the magnetic force between the bottom portion 404 and the magnetic device 502. The pin is selected from a material that is strong enough to withstand force while maintaining a diameter as small as possible.

In one embodiment, the pin is not fixedly attached to the clasp mechanism, but instead each end of the pin is located in a narrow slot on each sidewall of the clasp. This slot allows for the pin to slide along the length of the slot allowing for a natural adjustment as a wrist expands or contrasts.

Another advantage of the current embodiment is that once the strap has been adjusted for the desired fit, it will eventually acclimate to the new shape and resist moving out of that shape. So, for some users, you will only have to ever do this once.

For people who buy multiple clasps, the engage/disengage workflow is so fast and easy that you can swap the clasp anytime the mood strikes you.

In one embodiment, the pin 410 is located a distance from the second open end 408 so that the bend of the strap does not project outward from the second open end 410.

As describe above, the dimensions of interior of the clasp 400 are selected so that the clasp functions to frictionally hold the strap in place. In one example, the interior has a height of 6 mm, a width of 14 mm, and a length of 25 mm, with a pin having 0.5 mm diameter. These dimensions are exemplary only and any suitable dimension may be used.

The strap comprises a material that naturally resists bending, is at least somewhat compressible, and has friction when portions of the strap engage each other. The strap may comprise a material such as leather, stiffened rubber, plastic, hemp, or any other material that has these properties. The thickness of the strap is selected so that the strap interacts with the interior of the clasp as described above. The width of the strap can be any width that is less than the width of the interior of the clasp.

The clasp can comprise any rigid material that will be attracted to the magnet. For example, the clasp can be metal or a plastic embedded with magnetic material. In one embodiment, the clasp is magnetic and the end of the strap contains a material attracted to magnets.

Figure 21:
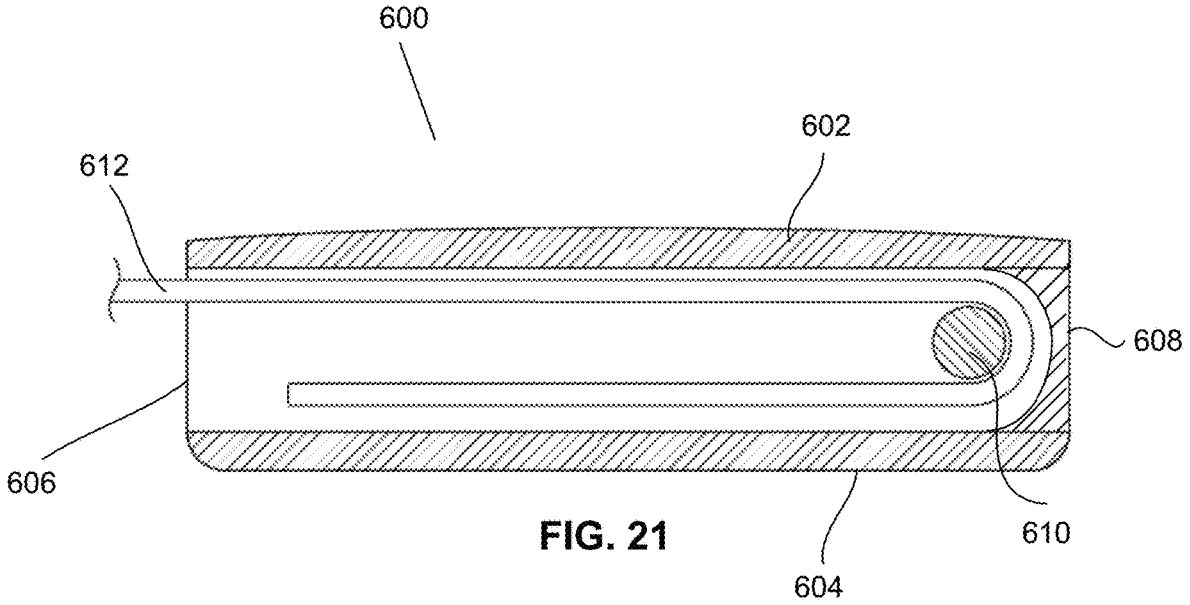
FIG. 21 is an alternative embodiment of the clasp where one end of the clasp is closed.
Figure 22:
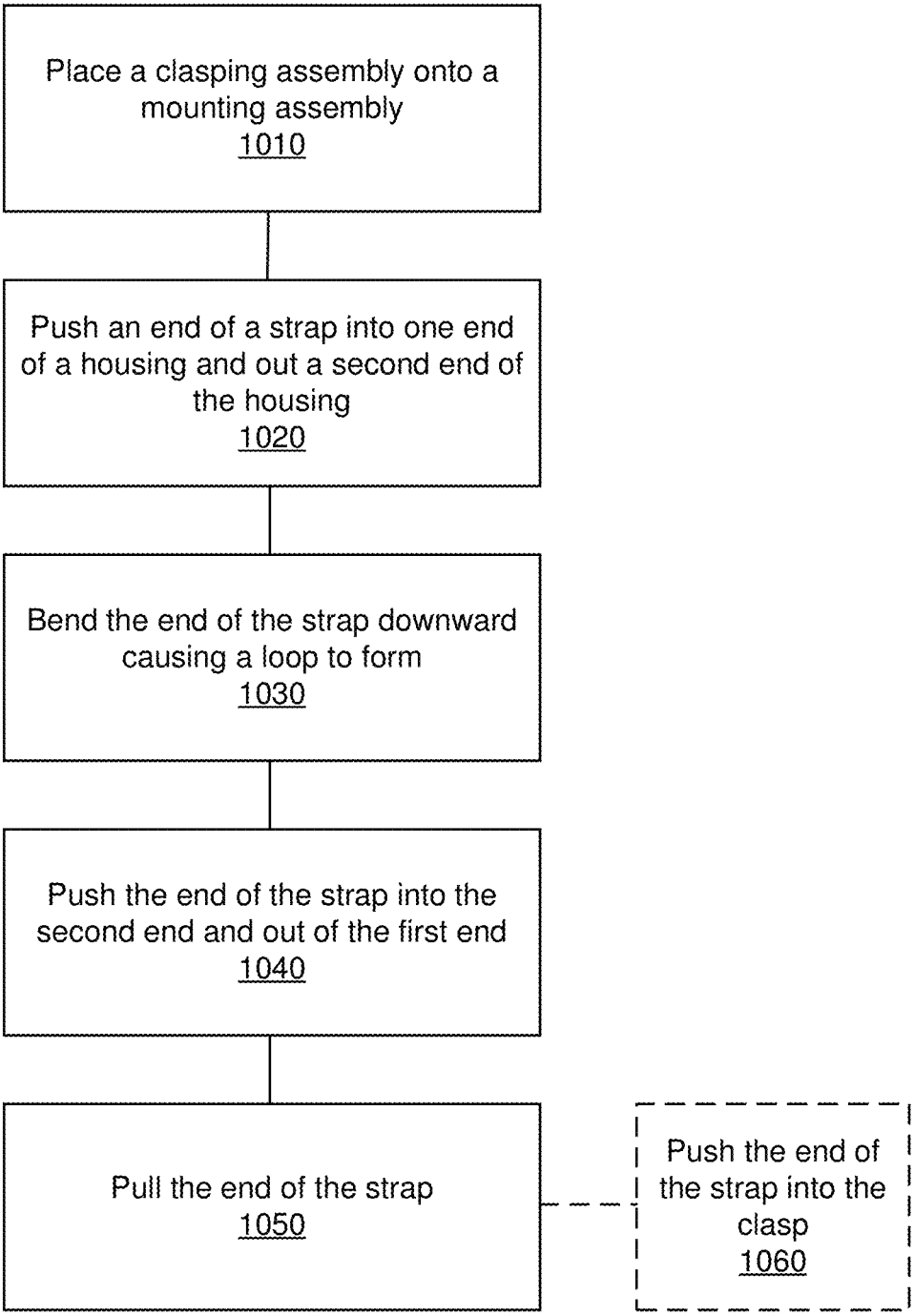
FIG. 22 is flowchart illustrating a method of using the device.
Figure 23A:
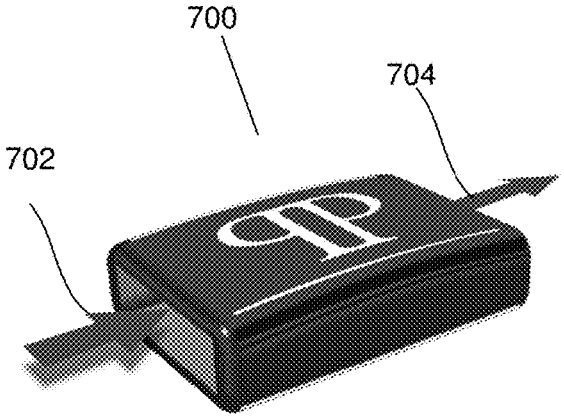
FIGS. 23A-D illustrate a method of affixing a strap to a clasp.
Figure 23B:
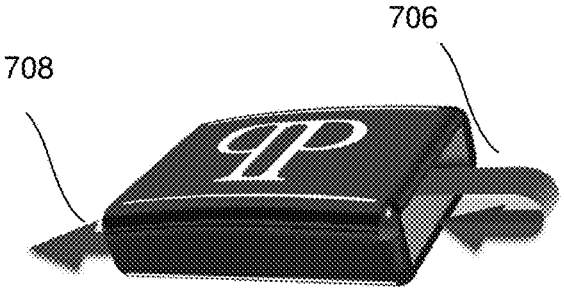
Figure 23C:
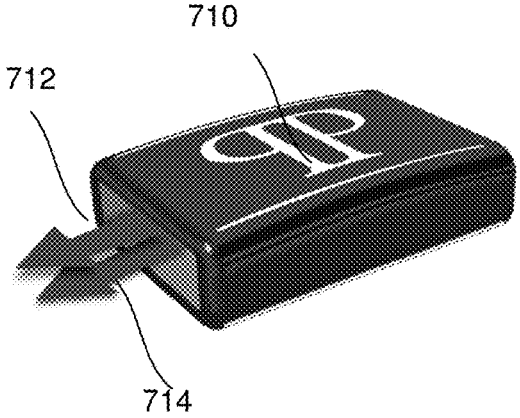
Figure 23D:
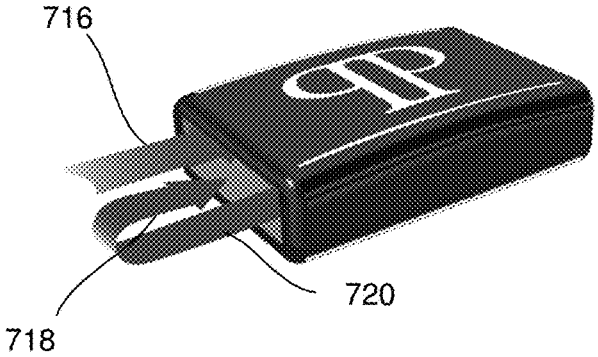

FIG. 21 illustrates an alternative embodiment of a clasp assembly 600. The clasp assembly has a top portion 602, a bottom portion 604, an open end 606, a closed end 608, and a pin 610 located in an interior of the clasp assembly. The pin 610 is located approximately equidistant from the top portion 602 and the bottom portion 604 and closer to the closed end 608 than the open end 606. A strap 612 is fed into the interior of the clasp at the open end 606 over the pin 610 towards the closed end 608. An interior of the closed end 608 is curved from the top portion 602 to the bottom portion 604. The curve forces the strap 612 to bend into a curve and to feed under the pin 610, and out the first open end 602. The clasp 600 and strap 612 function as described above with regards to FIGS. 16-20.

FIGS. 22 and 23A-C illustrates an exemplary method of using the clasp described in FIGS. 1-20 above. The method includes placing a clasp 700 onto a mounting assembly (1010). The clasp has a surface 710 that optionally displays a logo or a decorative feature. An end of a strap is pushed into an end of a housing 702 of the clasp and out a second end 704 (1020). The strap is bent downwards forming a loop in the strap 706 (1030). The end of the strap is pushed into the second opening and out the first opening 708 (1040). The end of the strap is pulled (1050) until the loop abuts or is adjacent a pin in the housing. The portion of the strap that enters the first opening 712 and the end of the strap 714 are pulled away from the housing to tighten the strap within the housing. If the user wishes to more securely tighten the engagement of the strap within the clasp, the user pushes the end of the strap 718 back into the first opening between the portion of the strap 716 that enters the first opening and a portion of the strap 720 that exits the housing (1060).

The method may further include that the strap being affixed to a glove and adjusting the tightness of the glove by pushing or pulling on the end of the strap.

The method may further include that the strap is looped around an object, such as a wrist or waist, and the tightness of the loop is adjusted by pushing or pulling on the end of the strap.

The method may further comprise pushing the end of the strap and a portion of the strap that is above the end towards the housing thereby forcing a portion of the strap that is looped out the second open end.

The method may further comprise pulling the loop of the strap until the end of the strap exits the housing through the second open end, and pulling the strap until the end of the strap exits the housing through the first open end.

The method may further comprise pulling, sliding, or lifting the clasp until the clasp disengages from a mounting assembly.

While several embodiments have been described herein that are exemplary of the present invention, one skilled in the art will recognize additional embodiments within the spirit and scope of the invention. Modification and variation can be made to the disclosed embodiments without departing from the scope of the disclosure. Those skilled in the art will appreciate that the applications of the embodiments disclosed herein are varied, however, it will be further appreciated that any particular feature or combination can be applied in conjunction with any other feature or combination as appropriate. In this regard, it is intended that such changes would still fall within the scope of the disclosure. Therefore, this disclosure is not limited to particular embodiments, but is intended to cover modifications within the spirit and scope of the disclosure.

What is claimed is:

1. A magnetic clasp system, the magnetic clasp system comprising:

a clasping assembly comprising a housing having an interior, the housing further comprising:

a top having a top exterior surface and a top interior surface;

a base having a base exterior surface and a base interior surface;

two sidewalls each having an exterior surface and an interior surface;

a first open end;

a second end; and a pin located in the interior of the housing; wherein the pin, the top interior surface, and the lower interior surface define a path therebetween configured to receive a strap, and wherein the strap enters the housing at the first open end, loops around the top of the pin back towards the first open end, and the strap where it returns is pressed against the strap where it enters by the lower interior surface, and wherein the base includes a magnetically responsive material; and a mounting assembly, the mounting assembly including a magnetically responsive material configured to draw the clasping assembly and the mounting assembly together when within a magnetic field thereof.

2. The magnetic clasp system of claim 1, wherein the pin is located proximally equidistant to the top interior surface and the bottom interior surface.

3. The magnetic clasp system of claim 1, wherein the strap comprises at least one layer of material and the mounting assembly is covered by a layer of the material.

4. The magnetic clasp system of claim 3, wherein the layer of material is comprised of at least one of leather, cloth, fabric, or other compressible material.

5. The magnetic clasp system of claim 1, wherein the strap is configured to be pushed or pulled by a user to adjust the size of the strap.

6. The magnetic clasp system of claim 1, wherein the housing is a unitary element.

7. The magnetic clasp system of claim 1, wherein the second end is an open end.

8. The magnetic clasp system of claim 1, wherein the second end is a closed end.

9. A method of adjustably affixing a strap, the method comprising:

placing a clasping assembly on top of a mounting assembly having a magnetically responsive material, wherein the clasping assembly comprises a housing having an interior, the housing further comprising:

a top having a top exterior surface and a top interior surface;

a base having a base exterior surface and a base interior surface;

two sidewalls each having an exterior surface and an interior surface;

a first open end;

a second open end; and a pin located in the interior of the housing and disposed between the two sidewalls;

pushing an end of a strap into the first open end of housing and out the second open end of the housing, wherein a portion of the strap is positioned above the pin in the interior of the housing;

bending the strap downward causing a loop to form in the strap;

pushing the end of the strap into the second open end and out of the first open end, wherein a portion of the strap is positioned below the pin; and pulling on the end of the strap until the bend in the strap abuts the pin.

10. The method of claim 9, wherein the strap is affixed to a glove.

11. The method of claim 10, wherein the tightness of the glove is adjusted by pushing or pulling on the end of the strap.

12. The method of claim 9, wherein the strap is affixed to the mounting assembly.

13. The method of claim 12, wherein the strap is looped around a substantially cylindrical or oval shaped object.

14. The method of claim 13, wherein the object is a wrist.

15. The method of claim 13, wherein the tightness of the loop is adjusted by pushing or pulling on the end of the strap.

16. The method of claim 15, further comprising:

pushing the end of the strap and a portion of the strap that is above the end towards the housing thereby forcing a portion of the strap that is looped out the second open end.

17. The method of claim 16, further comprising:

pulling the loop of the strap until the end of the strap exits the housing through the second open end; and pulling the strap until the end of the strap exits the housing through the first open end.

18. The method of claim 15, further comprising:

pulling, sliding, or lifting the clasp until the clasp disengages from the mounting assembly.

19. The method of claim 9, further comprising:

pushing the end of the strap into the first opening to compress all sections of the strap contained within the housing.

20. The method of claim 9, further comprising:

pushing the end of the strap into the first opening between an upper portion of the strap that enters the first opening and a lower portion of the strap that exits the first opening, wherein pushing the end of the strap compresses the upper portion of the strap and the lower portion of the strap.

21. A self-regulating magnetic clasp system, the self-regulating magnetic clasp system comprising:

a clasping assembly comprising a housing having an interior, the housing further comprising:

a top having a top exterior surface and a top interior surface;

a base having a base exterior surface and a base interior surface;

two sidewalls each having an exterior surface and an interior surface;

a first open end;

a second end; and a pin located in the interior of the housing; wherein the pin, the top interior surface, and the lower interior surface define a path therebetween configured to receive a strap, and wherein the strap enters the housing at the first open end, loops around the top of the pin back towards the first open end, and the strap where it returns is pressed against the strap where it enters by the lower interior surface, and wherein the base includes a magnetically responsive material; and a mounting assembly, the mounting assembly including a magnetically responsive material configured to draw the clasping assembly and the mounting assembly together when within a magnetic field thereof, and wherein the magnetic field formed therebetween is configured to apply a lateral force that is sufficient to keep the clasping assembly secured to the mounting assembly, but wherein the lateral force can allow for some lateral movement of the clasp assembly relative to the mounting assembly to prevent over-tightening of the strap around a user's wrist while still maintaining a secure connection.

* * * * *